US009955842B2

(12) United States Patent
Eisenhut et al.

(10) Patent No.: US 9,955,842 B2
(45) Date of Patent: May 1, 2018

(54) FLAT WIPING CLOTH WITH CLEANING LIP

(71) Applicant: Carl Freudenberg KG, Weinheim (DE)

(72) Inventors: Andreas Eisenhut, Leimen (DE); Ulla Reiman, Salo (FI); Ari Saari, Hajala (FI); Dennis Smeijer, Haule (NL)

(73) Assignee: CARL FREUDENBERG KG, Weinheim (DE)

( * ) Notice: Subject to any disclaimer, the term of this patent is extended or adjusted under 35 U.S.C. 154(b) by 403 days.

(21) Appl. No.: 14/411,179

(22) PCT Filed: Mar. 19, 2013

(86) PCT No.: PCT/EP2013/000840
§ 371 (c)(1),
(2) Date: Feb. 9, 2015

(87) PCT Pub. No.: WO2014/000836
PCT Pub. Date: Jan. 3, 2014

(65) Prior Publication Data

US 2015/0164297 A1 Jun. 18, 2015

(30) Foreign Application Priority Data

Jun. 25, 2012 (DE) ..... 10 2012 012 402

(51) Int. Cl.
*A47L 13/20* (2006.01)
*A47L 13/254* (2006.01)

(52) U.S. Cl.
CPC ..... *A47L 13/20* (2013.01); *A47L 13/254* (2013.01)

(58) Field of Classification Search
CPC ..... A47L 13/20; A47L 13/24; A47L 13/25; A47L 13/253; A47L 13/254; A47L 13/256; A47L 13/258
USPC ..... 15/228, 229.1–229.9
See application file for complete search history.

(56) References Cited

U.S. PATENT DOCUMENTS 3,528,120 A * 9/1970 Lindstrom ..... A47L 13/29 15/228
3,713,744 A 1/1973 Sims
4,888,229 A 12/1989 Paley et al.
5,613,263 A * 3/1997 Nolte ..... A47L 13/20 15/228
5,887,311 A * 3/1999 Kresse ..... D04D 9/00 15/228

(Continued)

FOREIGN PATENT DOCUMENTS

CN 2307531 Y 2/1999
CN 2678554 Y 2/2005

(Continued)

*Primary Examiner* — Mark Spisich
(74) *Attorney, Agent, or Firm* — Shumaker, Loop & Kendrick, LLP; James D. Miller

(57) ABSTRACT

A flat wiping cloth for a wiping cloth holder includes an elongated base. The elongated base includes a main cleaning surface and a sheetlike textile material. The sheetlike textile material does not include a base fabric with threads attached to the main cleaning surface. At least one cleaning lip is formed on the elongated base. The at least one cleaning lip is swivelable relative to the elongated base about a swiveling region.

12 Claims, 4 Drawing Sheets

(56) References Cited

U.S. PATENT DOCUMENTS

| | | | | |
|---|---|---|---|---|
| 6,141,820 | A * | 11/2000 | Schmiedhoff | A47L 13/20 15/228 |
| 7,181,801 | B1 * | 2/2007 | Kresse | A47L 13/58 15/229.1 |
| 2004/0107522 | A1 | 6/2004 | Paas | |
| 2004/0244131 | A1 | 12/2004 | Cassar | |
| 2007/0061987 | A1 | 3/2007 | Kresse et al. | |
| 2010/0031463 | A1 | 2/2010 | Adams et al. | |

FOREIGN PATENT DOCUMENTS

| | | | |
|---|---|---|---|
| CN | 201353128 | Y | 12/2009 |
| DE | 3139245 | A1 | 4/1983 |
| DE | 4439363 | * | 5/1996 |
| DE | 202004021372 | U1 | 10/2007 |
| EP | 983744 | * | 3/2000 |
| EP | 1166706 | * | 1/2002 |
| EP | 1212972 | A2 | 6/2002 |
| EP | 1591053 | * | 11/2005 |
| JP | 2-109531 | * | 4/1990 |
| JP | 10-262888 | * | 10/1998 |
| JP | 10-328109 | * | 12/1998 |
| JP | 11-89776 | * | 4/1999 |
| JP | 2000-201875 | * | 7/2000 |
| JP | 2001-104229 | * | 4/2001 |
| JP | 2002-102132 | * | 4/2002 |
| JP | 2006-296712 | * | 11/2006 |
| JP | 2011-131108 | * | 7/2011 |
| WO | 2005/041742 | * | 5/2005 |

* cited by examiner

FLAT WIPING CLOTH WITH CLEANING LIP

CROSS-REFERENCES TO RELATED APPLICATIONS

This application is a United States national phase application based on PCT/EP2013/00840 filed Mar. 19, 2013 which claims the benefit of German Patent Application No. DE 10 2012 012 402.3, filed Jun. 25, 2012. The entire disclosures of the above applications are hereby incorporated herein by reference.

FIELD OF THE INVENTION

The invention concerns a flat wiping cloth according to the preamble of patent claim 1.

BACKGROUND

Flat wiping cloths are known in the prior art, which are placed on so-called flat mops and used for the cleaning of surfaces. The flat wiping cloths are used in particular for the cleaning of floors.

Such a flat wiping cloth is known, for example, from the German patent application with file number DE 10 2011 107 648.8.

However, such flat wiping cloths are ill suited to cleaning regions and corners adjoining the relatively large surfaces being primarily cleaned, especially floors.

Such a region might be, for example, a tile baseboard which borders a tile floor.

With the known flat wiping cloths, the person doing the cleaning would not clean such a baseboard.

Either the flat wiping cloth would remain flat on the floor, so that only the narrow marginal regions of the flat wiping cloth would make contact with the vertical surfaces and only a partial cleaning would occur, such as the floor molding along a horizontal strip, or the housecleaner would attempt to bring the main cleaning surface of the flat wiping cloth as much as possible in contact with the vertical baseboard by placing the flat wiping cloth along the vertical direction.

But the latter process would have the drawback of the flat wiping cloth also touching the wall regions bordering the baseboard and possibly damaging, soiling or loosening the wall paint, since the width of the flat wiping cloth is usually larger (100 to 150 mm) than the typical widths of a molding strip (around 20 to 70 mm).

Given this background, a flat wiping cloth is known from DE 31 39 245 A1, which has an elongated base, with the base having a main cleaning surface and at least one cleaning lip which can swivel relative to a base region of the main cleaning surface.

The at least one cleaning lip can swivel about at least one desired swiveling region.

The base of this flat wiping cloth has a base fabric or backing fabric of warp and weft threads on which pile threads 1 to 2 cm in length are secured. Accordingly, the prior art shows a flat wiping cloth with a base fabric carrying additional threads.

These pile threads project to the outside. Such pile threads can rather easily discharge particles, since their free projecting ends cannot particularly easily secure particles.

Therefore, the known flat wiping cloth is ill suited for use in clean rooms. By a clean room is meant in the sense of this document a room in which the particles in the air are controlled in terms of size and number.

Furthermore, this flat wiping cloth has only limited service life, since individual pile threads can rather easily become detached during washing processes.

SUMMARY

Therefore, the problem of the invention is to configure and modify a flat wiping cloth of the kind mentioned above so that it removes dirt from corners and edge regions adjoining large areas being cleaned with particular effectiveness, and it releases as few particles as possible into the room being cleaned, while having long service life.

The present invention solves the aforementioned problem with the features of patent claim 1.

According to the invention, it has been discovered first of all how to create very broad and long projecting lip regions thanks to a desired swiveling region, which have a large region of overlap with a baseboard. The cleaning lips are part of the main cleaning surface, this part being able to swivel relative to a base region of the main cleaning surface. This base region is positioned preferably on the floor. In addition, it has been discovered that the base must have a sheetlike textile material, or it must be made from such a textile material, which releases as few particles as possible into the room being cleaned.

The prior art discloses base fabrics and pile threads which are directed toward a surface being cleaned. The prior art encompasses all sheetlike textile materials having so-called pile threads. In the case of velour, velvet, plush, tuftings and other textiles with three-dimensional structure, a thread system running perpendicular to the surface is defined as a pile. In the sense of this document, a base fabric is a backing fabric on which threads, especially pile threads, are flocked, sewn on as a fringe, tufted as yarn or yarn loops, or woven in.

According to the invention, on the contrary, a sheetlike textile material is used which has no projecting pile threads. Thus, according to the invention, all textile materials are used except for pile fabric, flocked fabric, or fabric with a fringe sewn on. A sheetlike textile material is used which consists of an essentially two-dimensional structure or a fiber/yarn arrangement. According to the invention, a sheetlike textile material is used in which the main direction of the yarns or fibers is oriented within the textile surface.

Surprisingly, the sheetlike textile material has much less tendency to give off particles than that of pile fabrics. Moreover, the production costs are relatively low. For the same surface weight and starting material, pile fabrics are the most expensive, woven somewhat better, knitted even better, and nonwoven are the best. The sheetlike textile material is relatively easy to work with. A pile fabric, on the other hand, requires increased attention and handling during production on account of its thickness and two-sided nature. The former advantages of pile fabrics, namely the stability and high water uptake capacity, can be compensated rather problem-free by the use of microfibers in woven, knitted, and nonwoven materials.

Accordingly, a flat wiping cloth is specified that removes dirt especially effectively from corners and edge regions adjoining large surfaces being cleaned, wherein it releases as few particles as possible into the room being cleaned, while having a long service life. Consequently, the stated problem is solved.

In particular, the possibility exists of providing a surface with sections of pure microfibers, which realizes a high water and dirt uptake, but also large friction. The possibility exists of providing sections with coarse yarns (e.g., NONmicrofibers), so that there is less water and dirt uptake, but also less friction. The sections can be provided in the form of stripes, as is done today with many knitted fabrics, for example, by knitting five courses with microfibers and two courses with other yarns all the time.

The sheetlike textile material could be formed as a knitted, a crocheted, a woven or a nonwoven fabric. These sheetlike textile materials have very few threads or fibers which project by a free end in the direction of a surface being cleaned. Therefore, they give off very few particles into their surroundings. This holds in particular for the use of endless fibers or filament yarns.

The base could consist entirely of the sheetlike textile material. Such a base has good material uniformity.

A desired swiveling region could be fashioned as a seam, about which the cleaning lip can swivel. A seam can be incorporated permanently and in very definite manner in the base.

A desired swiveling region could be fashioned as glue or welded strips or sewn-on strips about which the cleaning lip can swivel. Such a desired swiveling region can be formed quickly and at low cost.

A desired swiveling region could be fashioned as a thinned-out material section, about which the cleaning lip can swivel. In this way, one can save on material.

The cleaning lip could protrude 5 to 50 mm from a core region, into which a mounting or a support flap of a wiping cloth holder can be inserted. Such a cleaning lip can be especially easily applied or swiveled.

At least one cleaning lip could have different widths along its length. The width of the cleaning lips can be the same, but also different around the circumference of the flat wiping cloth. The cleaning lip need not necessarily have the same width along its entire length. In this context, trapezoidal or triangular cleaning lips are also conceivable. In this way, even complex structures can be properly cleaned.

The base could have two long sides and two short sides, forming a cleaning lip on only one long side. The forming of only one cleaning lip causes only a slight manufacturing cost.

The base could have two long sides and two short sides, forming a cleaning lip each on one long side and two short sides. In this way, a U-shaped cleaning lip arrangement is created.

The base could have two long sides and two short sides, forming a cleaning lip each on the long sides and the short sides. This will create an encircling cleaning lip arrangement.

At least one pocket could be arranged on the base, into which a mounting of a wipe cloth holder can be inserted. Thanks to this specific configuration, a so-called "butterfly" or "pocket" mop for example can be connected to the flat wiping cloth. Such a wiping cloth holder has two support flaps which can swivel relative to each other and which can be inserted into two pockets of the flat wiping cloth. The pockets are arranged on the long ends of the elongated base of the flat wiping cloth.

Tabs could be arranged on the base, which can be inserted by force locking or form fitting into receiving arrangements of a wiping cloth holder. For this, the tabs are arranged in the region of the long ends of the elongated base. The tabs can be placed around a support flap of a wipe cloth holder such that the flat wiping cloth is subjected to tension. The tabs can be inserted into clamp-like gaps on the support flaps of a wipe cloth holder. Thus, there is a form-fitting connection between the tabs and a support flap of a wipe cloth holder.

Sheetlike regions could be coordinated with the base, which can be placed with form fitting against receiving regions of a wipe cloth holder. In this context, it is specifically conceivable to form receiving regions on the underside of a support flap of a wipe cloth holder. The receiving regions could interact with the sheetlike regions on the base so that a hook and eye closure is formed.

A wipe cloth holder could have a flat wiping cloth of the kind specified here.

The flat wiping cloth specified here is especially suitable for use in a clean room, since the sheetlike textile material gives off only very few particles and holds up even after many washing processes.

By a clean room is meant in the sense of this document a room in which the particles in the air are controlled in terms of size and number.

In the sense of this document, a yarn is a linear textile which is made from several staple fibers twisted together. Such a yarn is a so-called staple fiber yarn. A yarn is also a linear textile which is made from several endless fibers that are laid/twisted together. Such a yarn is a so-called filament yarn. A twine is a linear textile which consists of at least two yarns twisted together.

In the sense of this document, a thread is a linear textile structure which is fashioned as a yarn or a twine. This encompasses both staple fibers and filament yarns or filament twines.

BRIEF DESCRIPTION OF THE DRAWINGS

The drawings show

DETAILED DESCRIPTION OF THE INVENTION

Figure 1:
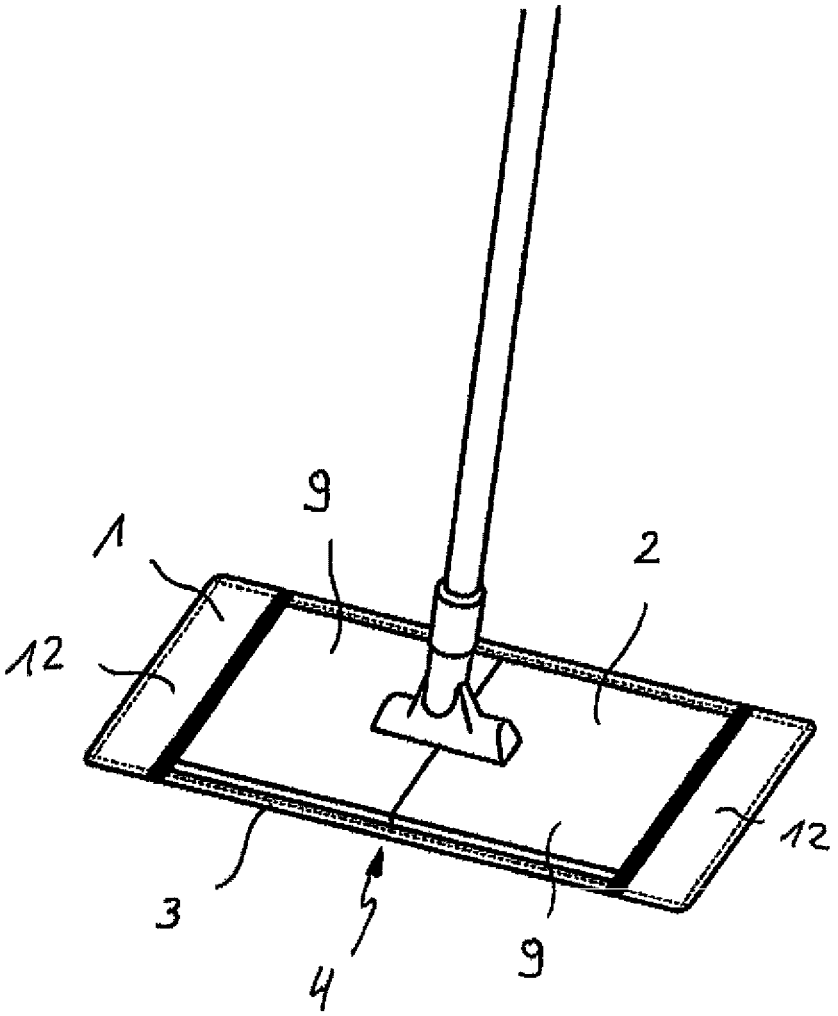
Fig. 1 PRIOR ART
FIG. 1, a perspective view of a flat mop of the prior art with flat wiping cloth arranged on it, FIG. 2, the flat wiping cloth of FIG. 1 in schematic view with crocheted, sewn or bordered edge, FIG. 3, a flat wiping cloth with only one cleaning lip, formed on a front long side, FIG. 4, a flat wiping cloth with three cleaning lips, one formed on a front long side and two on the short sides, and FIG. 5, a flat wiping cloth with four cleaning lips.
Figure 2:
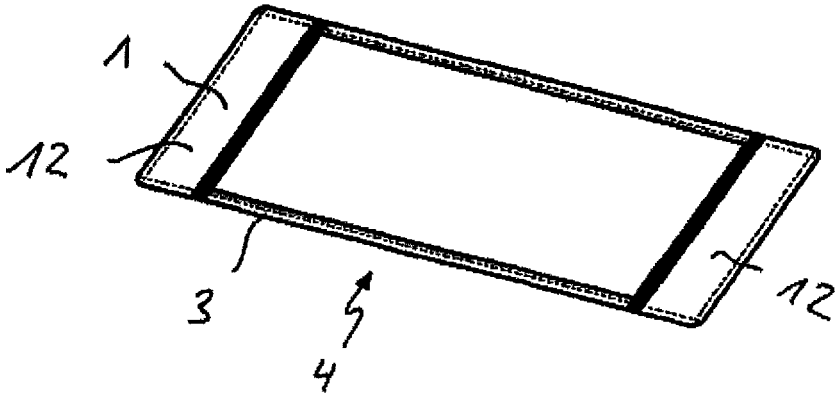
Fig. 2 PRIOR ART

FIGS. 1 and 2 show a flat wiping cloth 1 of the prior art for arrangement on a wipe cloth holder 2, comprising an elongated base 3, wherein the base 3 has a main cleaning surface 4. The flat wiping cloth 1 has a textile margin which is crocheted, sewn or bordered. This is shown by broken line.

Figure 3:
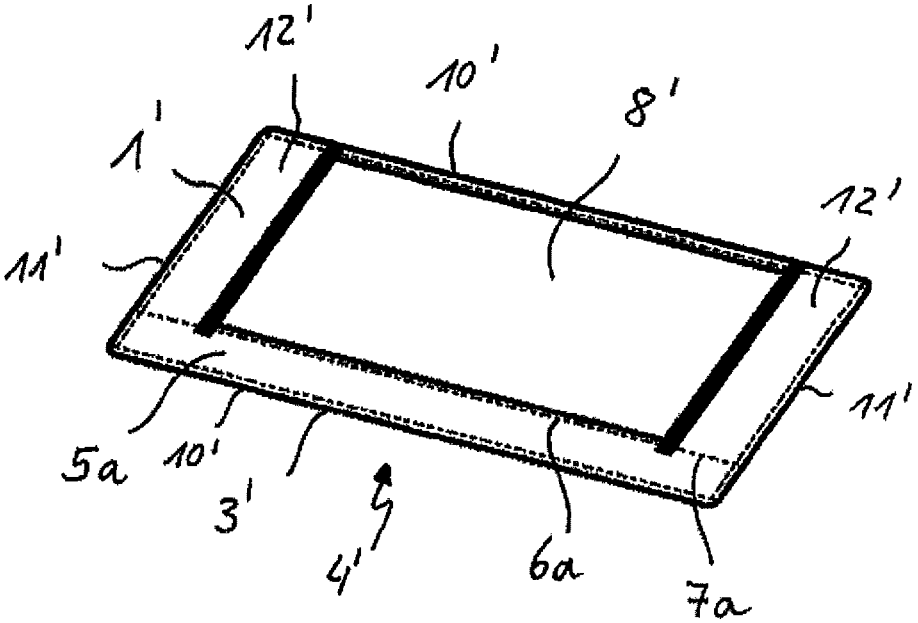

FIG. 3 shows a flat wiping cloth 1' for arrangement on the wipe cloth holder 2, comprising an elongated base 3', wherein the base 3' has a main cleaning surface 4' and at least one cleaning lip **5*a* which can swivel relative to a base region of the main cleaning surface 4', and the at least one cleaning lip 5*a* has at least one desired swiveling region 6*a***.

The cleaning lip **5*a* is part of the main cleaning surface 4'. The cleaning lip 5*a*, like the base region of the main cleaning surface 4'**, is at first turned toward the floor, but it can be swiveled relative to the floor and to the base region, while the base region remains on the floor.

The base 3' has a sheetlike textile material, not having a base fabric with attached threads in any portion of the main cleaning surface 4'.

The sheetlike textile material can be fashioned as a knitted, a crocheted, a woven or a nonwoven fabric. The base 3' consists of the sheetlike textile material. The desired swiveling region 6*a* is fashioned as a seam 7*a*, about which the cleaning lip 5*a* can swivel.

The cleaning lip 5*a* protrudes 5 to 50 mm from a core region 8', into which a mounting or a support flap 9 of a wipe cloth holder 2 according to FIG. 1 can be inserted.

Figure 4:
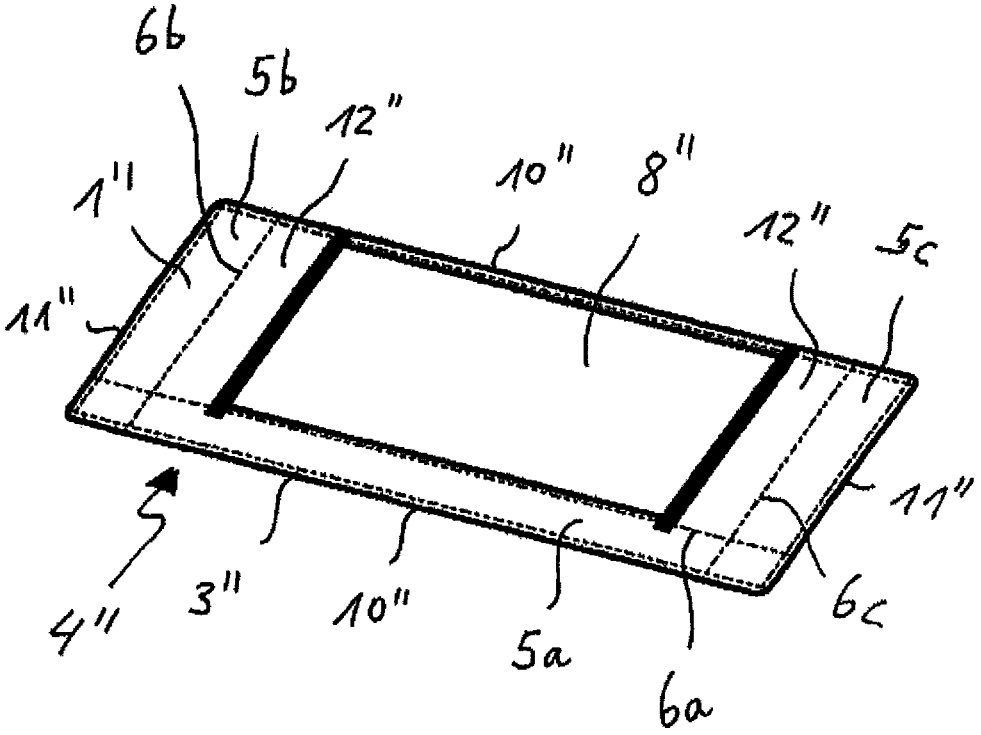
Figure 5:
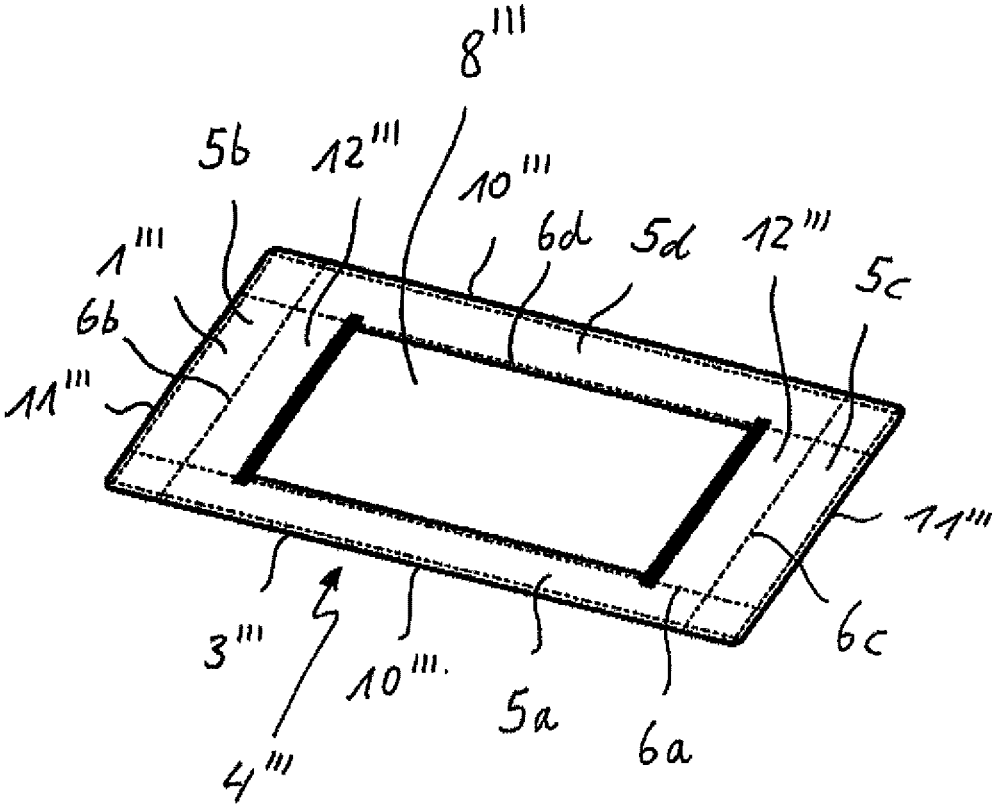

The features described thus far in regard to FIG. 3 also hold for the flat wiping cloths 1" and 1'" of FIGS. 4 and 5.

The base 3' of FIG. 3 has two long sides 10' and two short sides 11', the cleaning lip 5*a* being formed only at one long side 10'.

FIG. 4 shows the flat wiping cloth 1" in which the base 3" has the two long sides 10" and the two short sides 11", with a cleaning lip 5*a*, 5*b*, 5*c* formed each on one long side 10" and two short sides 11".

FIG. 5 shows the flat wiping cloth 1'", in which the base 3'" has two long sides 10'" and two short sides 11'", with a cleaning lip 5*a*, 5*b*, 5*c*, 5*d* formed each on the long sides 10'" and the short sides 11'".

On the base 3, 3', 3", 3'" of the flat wiping cloths 1, 1', 1", 1'" depicted here there are arranged two pockets 12, 12', 12", 12'" each, into which the one mounting or the one support flap 9 of the wipe cloth holder 2 can be inserted.

The flat wiping cloths 1, 1', 1", 1'" shown in FIGS. 1 to 5 are rectangular or mostly rectangular in shape, but need not be rectangular. The elongated base 1, 1', 1", 1'" can also be essentially trapezoidal, or have a different shape.

FIGS. 1 and 2 show a flat wiping cloth 1 without a cleaning lip, but only with normal crocheted, sewn or bordered textile edge. This mop edge is also indicated by the broken lines.

FIGS. 3 to 5 show a new kind of the flat wiping cloth 1', 1", 1'" with the cleaning lips 5*a*, 5*b*, 5*c*, 5*d*. The outer edges of the cleaning lips 5*a*, 5*b*, 5*c*, 5*d* are likewise crocheted, sewn or bordered. This is shown by the broken lines near the outer edges of the flat wiping cloth 1', 1", 1'". Furthermore, the foldable cleaning lips 5*a*, 5*b*, 5*c*, 5*d* are integrated, being of step form, for example. This is shown by the broken lines with larger spacing from the outer edges.

The invention claimed is:

1. A flat wiping cloth for a wiping cloth holder comprising:

an elongated base comprising of a sheetlike textile material having a first short side, a second short side formed opposite the first short side, a first long side, and a second long side formed opposite the first long side, first and second pockets formed on the elongated base configured for coupling the flat wiping cloth to the wiping cloth holder, the elongated base including a main cleaning surface having a core region and at least two cleaning lips, each of the cleaning lips comprising a swiveling region which swivels about a seam of the sheetlike textile material, wherein the sheet like material does not include a base fabric with threads attached to the main cleaning surface, a first one of the cleaning lips extending along an entirety of the first short side of the elongated base and wherein the seam about which the first one of the cleaning lips swivels also extends along the entirety of the first short side and further wherein the first cleaning lip intersects a second one of the cleaning lips extending along the entirety of the first long side of the elongated base and wherein the seam about which the second one of the cleaning lips swivels also extends along the entirety of the first long side of the elongated base, and wherein the seams of the first and second cleaning lips intersect and cross over each other at a corner of the elongated base adjacent one of the pockets.

2. The flat wiping cloth of claim 1, wherein the textile material is one of a knitted fabric, a crocheted fabric, a woven fabric, and a nonwoven fabric.

3. The flat wiping cloth of claim 1, wherein each of the swiveling regions is one of a glue strip, a welded strip, and a sewn-on strip.

4. The flat wiping cloth of claim 1, wherein each of the swiveling regions is configured as a thinned-out material section.

5. The flat wiping cloth of claim 1, wherein the core region is configured for mounting to a support flap of the wiping cloth holder, wherein each of the cleaning lips protrudes from the core region a distance in a range of about 5 millimeters to about 50 millimeters.

6. The flat wiping cloth of claim 1, wherein each of the cleaning lips has a varying width.

7. The flat wiping cloth of claim 1, wherein three cleaning lips are formed on the elongated base, wherein a third one of the three cleaning lips is formed on the second short side of the elongated base.

8. The flat wiping cloth of claim 1, wherein four cleaning lips are formed on the elongated base, wherein a third one of the four cleaning lips is formed on the second short side of the elongated base and a fourth one of the four cleaning lips is formed on the second long side of the elongated base.

9. The flat wiping cloth of claim 1, wherein the elongated base includes tabs disposed thereon configured for receiving the wiping cloth holder.

10. The flat wiping cloth of claim 1, wherein the elongated base includes sheetlike regions disposed thereon configured for receiving the wiping cloth holder.

11. The flat wiping cloth of claim 1, wherein a portion of the swiveling region of the first one of the cleaning lips extends along a first long side of the first pocket and wherein a portion of the swiveling region of the second one of the cleaning lips extends along a first short side of the first pocket.

12. The flat wiping cloth of claim 11, wherein the first pocket is formed at a first end of the core region of the elongated base and wherein the second pocket is formed at a second end of the core region disposed opposite the first end thereof.

* * * * *